US005270799A

United States Patent [19]

Rose

[11] Patent Number: 5,270,799

[45] Date of Patent: Dec. 14, 1993

[54] MANUAL RESET THERMOSTAT SWITCH

[75] Inventor: Derek J. Rose, Mansfield, Ohio

[73] Assignee: Therm-O-Disc, Incorporated, Mansfield, Ohio

[21] Appl. No.: 9,967

[22] Filed: Jan. 27, 1993

[51] Int. Cl.[5] ..... H01H 37/52; H01H 37/70

[52] U.S. Cl. ..... 337/354; 337/348; 337/91

[58] Field of Search ..... 337/354, 348, 334, 367, 337/56, 91

[56] References Cited

U.S. PATENT DOCUMENTS 2,911,503 11/1959 Garbers ..... 337/56

5,157,370 10/1992 Engelbach et al. ..... 337/354

*Primary Examiner*—Harold Broome

*Attorney, Agent, or Firm*—Jones, Day, Reavis & Pogue

[57] ABSTRACT

Upper and lower flexible blades carry normally closed contacts that are opened by upward movement of the upper blade responsive to snapping of a bimetal disc. The disc is reset by a pushbutton movable from a rest position to a depressed reset position. In its reset position, part of the reset button extends past the upper blade into engagement with the lower blade for moving and holding the lower contact away from the upper contact to prevent reclosing of the contacts until the pushbutton is moved back toward its rest position.

10 Claims, 3 Drawing Sheets

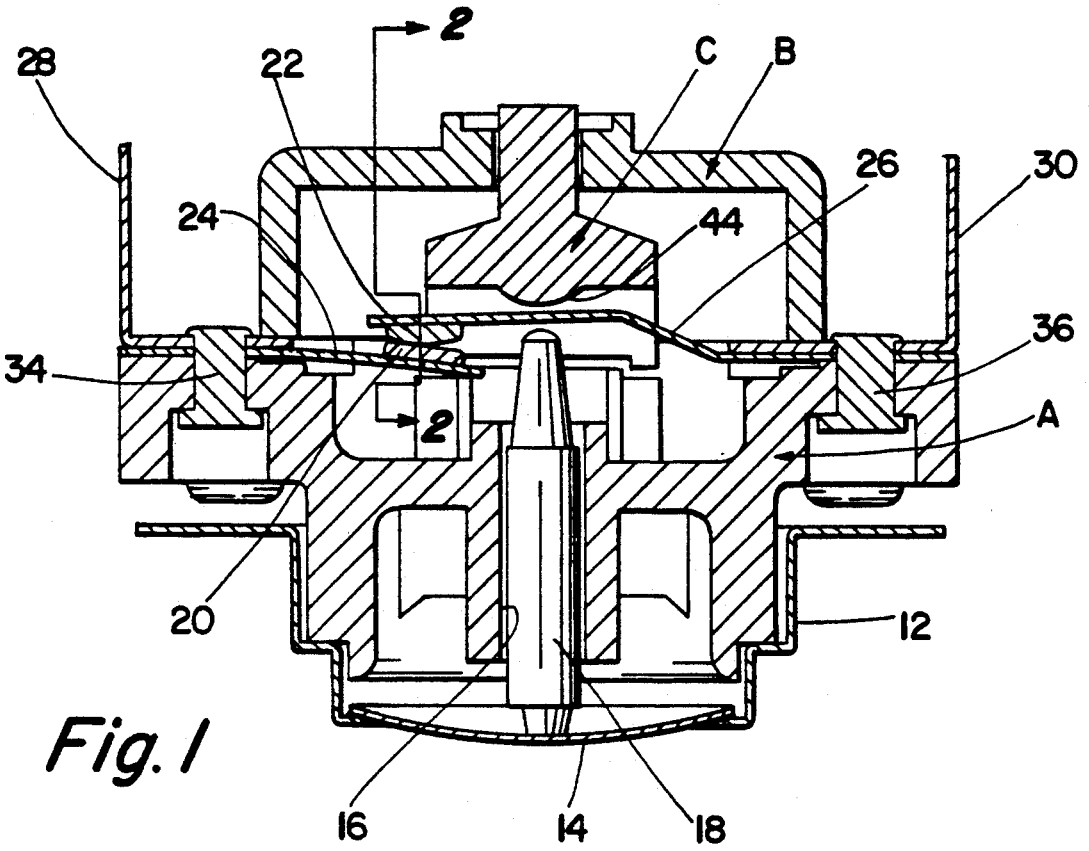
Fig. 1
Fig. 2
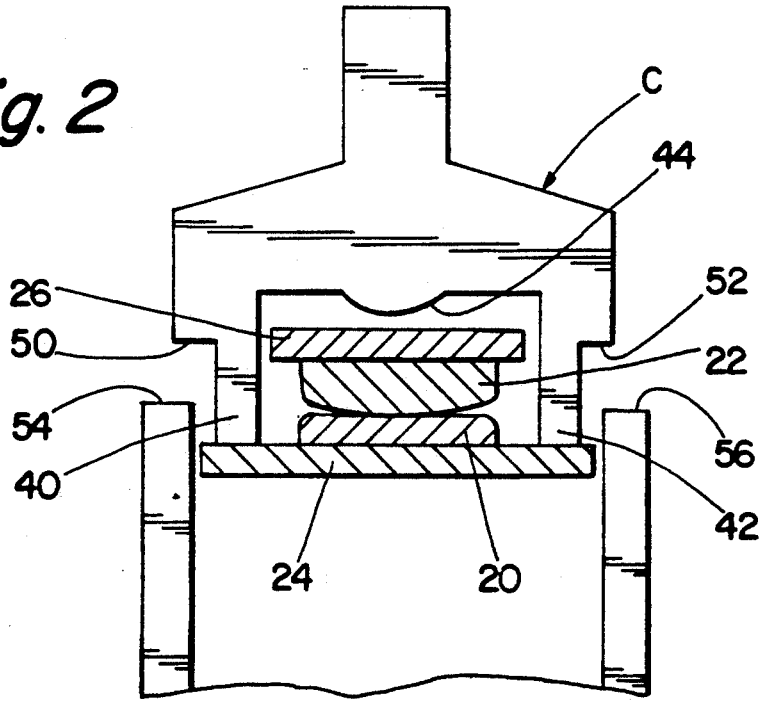

MANUAL RESET THERMOSTAT SWITCH

BACKGROUND OF THE INVENTION

This application relates to the art of switches and, more particularly, to manually resettable thermostatic switches that automatically move to an open condition responsive to an elevated temperature. The invention is particularly applicable to thermostatic switches that use a bimetal disc cooperating with a bumper for opening the switch contacts and will be described with specific reference thereto. However, it will be appreciated that the invention has broader aspects and can be used in other types of switches.

Devices such as appliances, heaters and furnaces commonly have a temperature limit switch for deactivating the device responsive to an undesirably elevated temperature condition. Reactivation of the device requires manual resetting of the switch. In some old designs, it was possible to override the temperature limit switch by holding a reset button down. This creates a dangerous condition because it allows the device to be operated even though an undesirably elevated temperature condition exists. In more recent designs, the switch remains open even though the manual reset button is held in its depressed reset position and this prevents overriding of the temperature limit switch. This application concerns the latter type of temperature limit switch.

SUMMARY OF THE INVENTION

A switch of the type described has both of its normally closed contacts mounted on flexible blades. This is in contrast to normal switches that have one movable contact and a stationary contact. One flexible blade moves responsive to an undesirably elevated temperature condition to open the contacts. The other blade is moved responsive to depression of a manually operable reset pushbutton for holding the contacts separated to prevent reclosing of same until the pushbutton is returned toward its normal rest position.

In a preferred arrangement, the switch includes upper and lower flexible blades carrying upper and lower normally closed contacts. A manually operable reset pushbutton is movable from a rest position to a depressed reset position. In its reset position, the pushbutton has engagement means that extends past the upper flexible blade into engagement with the lower blade for bending the lower blade to move and hold the lower contact away from the upper contact. This prevents reclosing of the contacts until the pushbutton is moved from its depressed reset position back toward its rest position.

In a preferred arrangement, the engagement means on the pushbutton straddles the upper blade to engage the lower blade. In another arrangement, the upper blade may have an opening therein through which the engagement means extends into engagement with the lower blade.

It is principal object of the present invention to provide an improved manually resettable thermostatic switch.

It is also an object of the invention to provide such a switch that has both of its normally closed contacts carried by flexible blades.

It is another object of the invention to provide such a switch with a reset pushbutton that engages and bends the lower blade to hold the lower contact spaced from the upper contact in the reset position of the pushbutton to prevent overriding of the thermostatic switch.

BRIEF DESCRIPTION OF DRAWING

FIG. 1 is a cross-sectional elevational view of a switch constructed in accordance with the present application;

FIG. 2 is a partial cross-sectional elevational view taken generally on line 2—2 of FIG. 1, and with portions of the switch case and cover omitted for clarity of illustration;

DESCRIPTION OF PREFERRED EMBODIMENTS

Figure 3:
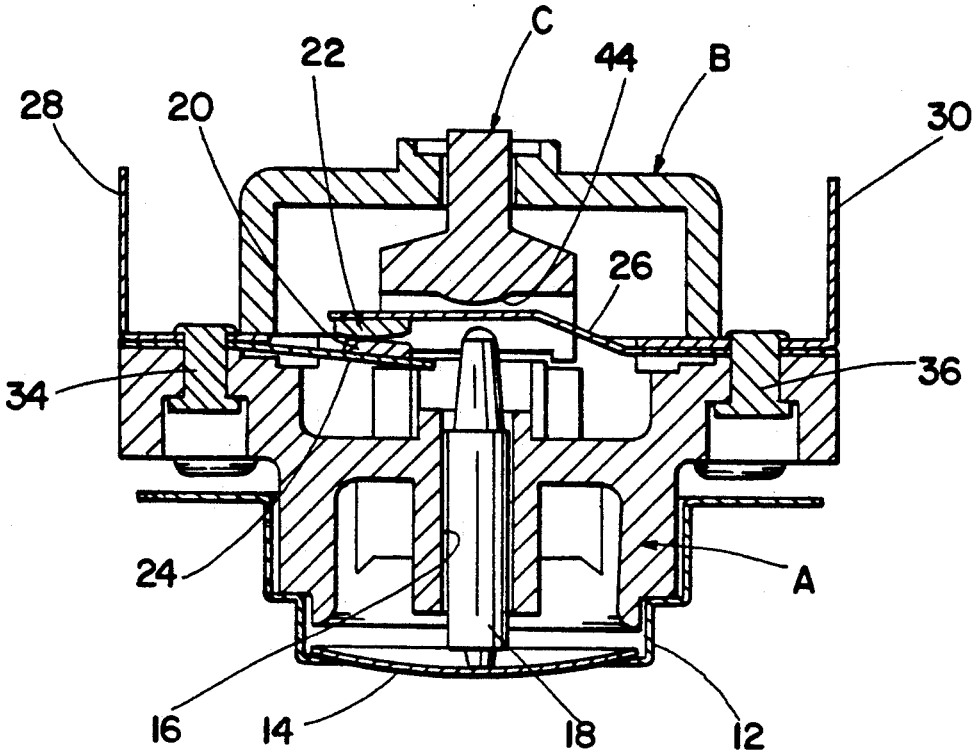
FIG. 3 is a cross-sectional elevational view showing the switch in its closed position.

Referring now to the drawing, wherein the showings are for purposes of illustrating preferred embodiments of the invention only and not for purposes of limiting same, FIG. 1 shows a manual reset thermostat switch constructed in accordance with the present application. The switch includes a switchcase A and a cover B of dielectric material.

A disc cup 12 secured to the bottom portion of switchcase A supports a bimetal disc 14 that is shown curved downwardly in the normally closed position of the switch. Disc 14 snaps into an opposite bowed position when it is heated to a predetermined temperature. Switchcase A has an elongated bore 16 reciprocatingly receiving a bumper 18 having one end engaging disc 14.

A pair of normally closed contacts 20, 22 are carried by flexible blades 24, 26 that are attached to switchcase A and to terminals 28, 30 by rivets 34, 36. When disc 14 snaps to its opposite curved position, bumper 18 moves longitudinally into engagement with flexible blade 26 and bends same upwardly for separating contact 22 from contact 20. Disc 14 remains in its opposite curved position until it is manually pushed back to the position shown in FIG. 1. A manually operable reset button C is provided for resetting the switch.

In a conventional switch, only contact 22 is attached to a flexible blade to enable movement of such contact. The opposite contact 20 is normally considered a fixed contact that is mounted on a fixed support that does not move. In accordance with the present application, contact 20 is also mounted on a flexible blade 24 that cooperates with reset pushbutton C for maintaining separation of contacts 20, 22 when pushbutton C is depressed to reset the disc and this prevents overriding of the switch. The contacts cannot be closed until the pushbutton is moved back towards its rest position.

As shown in FIG. 2, pushbutton C has a pair of spaced-apart legs 40, 42 that straddle flexible blade 26. Flexible blade 24 is wider than blade 26 so that blade 24 is engaged by legs 40, 42 when pushbutton C is depressed. A rounded projection 44 on pushbutton C engages blade 26 when pushbutton C is depressed for acting through bumper 18 to move disc 14 back to its normal position shown in FIG. 1. During this movement of the pushbutton to reset disc 14, legs 40, 42 bend blade 24 downwardly to move and hold contact 20 away from contact 22 as long as pushbutton C remains in its depressed reset position. Upon release of pushbutton C for movement of same back toward its rest position, blade 24 and its contact 20 will move upwardly to allow reclosing contacts 20, 22.

Legs 40, 42 on pushbutton C have external shoulders 50, 52 for cooperation with abutments 54, 56 on switchcase A to limit downward movement of pushbutton C.

Figure 4:
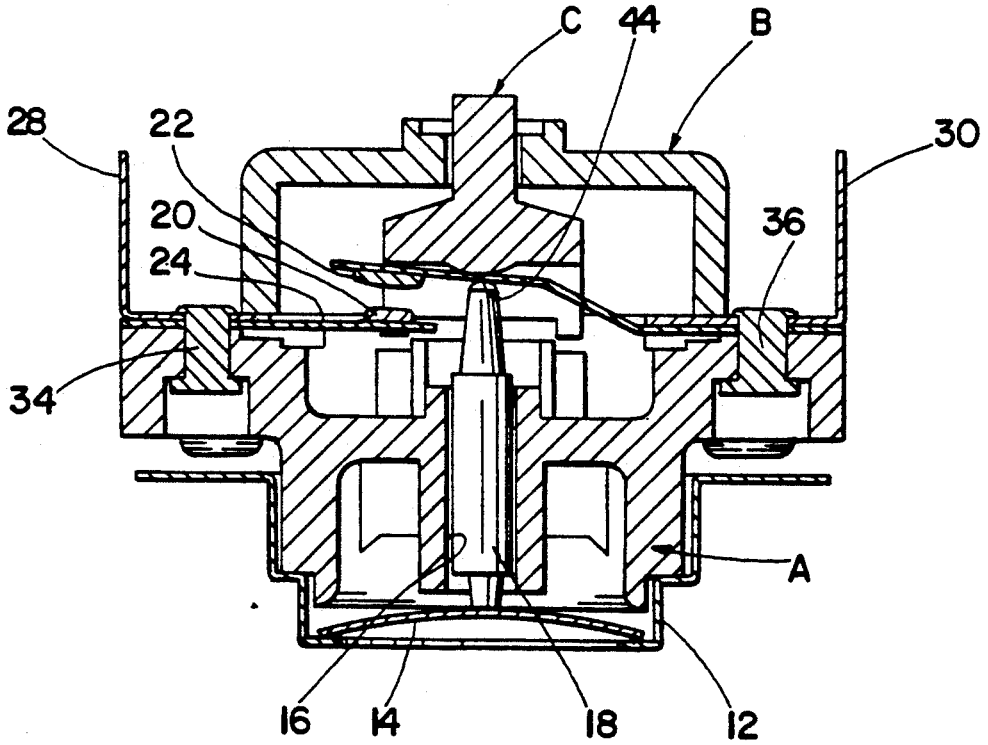
FIG. 4 is a cross-sectional elevational view showing the switch in an open position.
Figure 5:
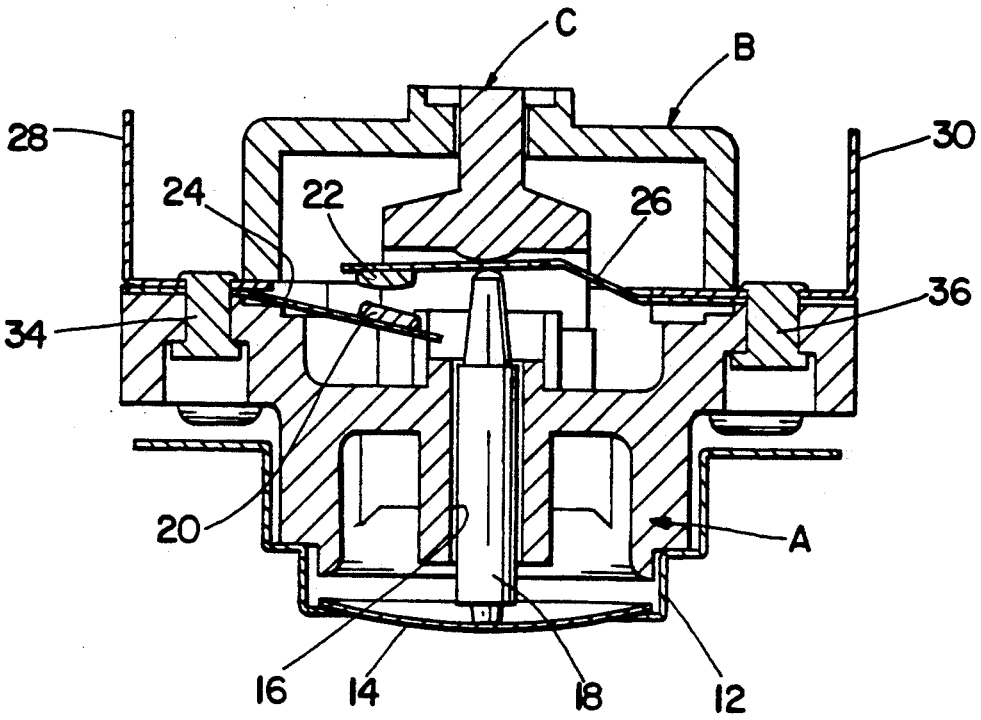
FIG. 5 is a cross-sectional elevational view showing the switch in a reset position.

FIG. 3 shows the switch in its normal closed position. FIG. 4 shows the switch after disc 14 has snapped to its reverse position opening the contacts. FIG. 5 shows pushbutton C in its depressed reset position holding contact 20 downwardly spaced from upper contact 22.

Figure 6:
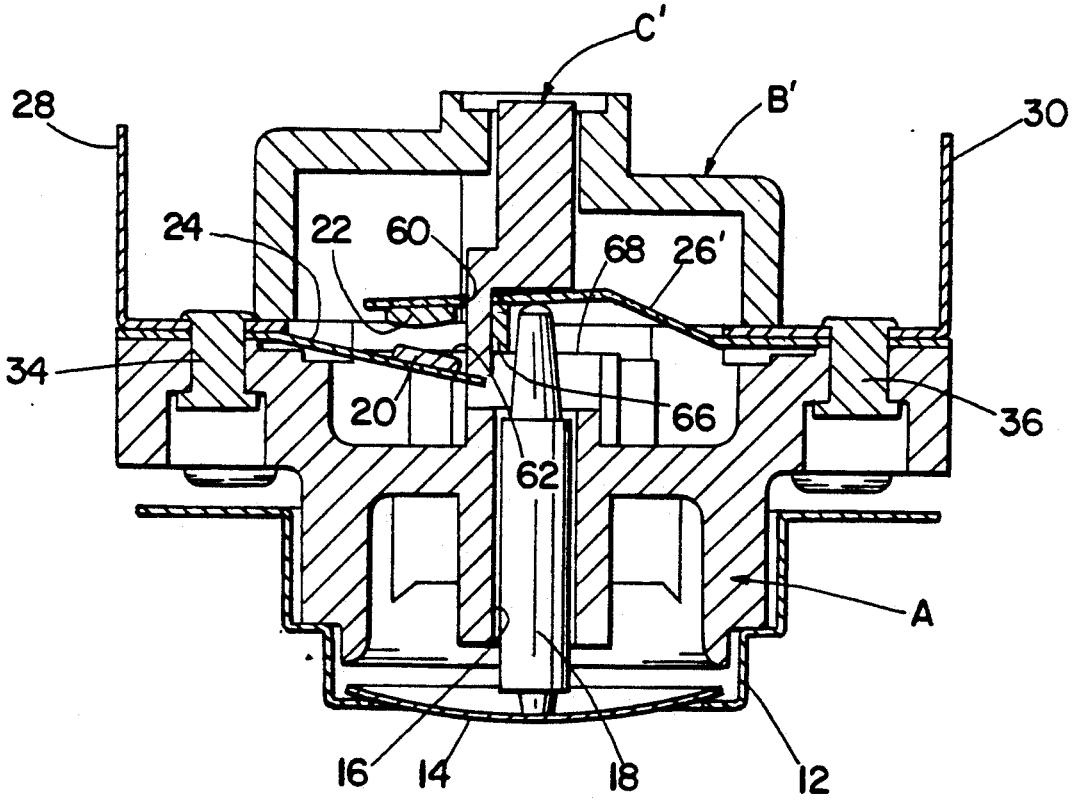
FIG. 6 is a cross-sectional elevational view of another embodiment.

FIG. 6 shows another arrangement wherein like parts are given like numerals. In this arrangement, upper blade 26' has an opening 60 therethrough for receiving a projection 62 on reset pushbutton C'. Projection 62 engages blade 24 when pushbutton C' is moved downwardly to its reset position for moving and holding contact 20 spaced from contact 22. Reset pushbutton C' has a shoulder 66 thereon engageable with an abutment surface 68 on switchcase A in the fully depressed reset position of the pushbutton.

In the arrangements shown and described, the reset pushbutton defines a manually operable means for manually resetting the switch. Legs 40, 42 on pushbutton C and projection 62 on pushbutton C' define engagement means for engaging blade 24 to move and hold the lower contact spaced from the upper contact when the pushbutton is depressed to its reset position. Upon return of the pushbutton toward its rest position, the lower blade and its contact are free to move upwardly for reclosing the contacts.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the claims.

I claim:

1. A switch having a pair of normally closed movable contacts, manually resettable temperature responsive means independent of said movable contacts for opening said contacts by moving one said contact away from the other, manually operable means movable from a rest position to a reset position for resetting said temperature responsive means to move said one contact back into engagement with the other said contact, said manually operable means in said reset position thereof being operative to move and hold the other said contact away from said one contact to prevent reclosing of said contacts until said manually operable means is returned toward said rest position, said manually operable means being shaped and positioned for applying force to reset said temperature responsive means independently of movement of said other contact so that movement of said other contact by movement of said manually operable means applied no resetting force to said temperature responsive means.

2. The switch of claim 1 wherein said contacts are on flexible blades and said one contact and its blade are above said other contact and its blade, said manually operable means having engagement means that extends past said one contact and its blade into engagement with said blade of said other contact when said manually operable means is moved to said reset position.

3. The switch of claim 2 wherein said blade of said one contact has an opening through which said engagement means extends.

4. The switch of claim 2 wherein said blade of engagement means straddles said blade of said one contact.

5. A manually resettable thermostatic switch comprising upper and lower flexible blades carrying normally closed upper and lower contacts, a bimetal disc having a normal bowed condition and being snapable to an opposite bowed condition responsive to an elevated temperature for opening said contacts, a bumper extending between said disc and said upper blade for bending said upper blade away from said lower blade to open said contacts by moving said upper contact away from said lower contact when said disc moves to said opposite bowed condition, a manually operable reset pushbutton movable from a rest position to a depressed reset position for manually returning said disc to its normal bowed condition by applying force to said bumper for moving said bumper longitudinally, said pushbutton in said reset position thereof engagement means that extends freely past said upper blade and contact into engagement wit said lower blade for bending said lower blade away from said upper blade and holding said lower contact away from said upper contact to prevent reclosing of said contacts until said pushbutton is returned toward its rest position.

6. The switch of claim 5 wherein said reset pushbutton acts through said upper flexible blade for applying longitudinally force to said bumper for manually returning said disc to its normal bowed condition.

7. The switch of claim 5 wherein said reset pushbutton is substantially aligned longitudinally with said bumper.

8. The switch of claim 5 including a housing having a cavity, said upper flexible blade being fixedly attached to said housing and projecting into said cavity past said bumper and said reset pushbutton, said upper flexible blade having a free end portion with said upper contact thereon, said lower flexible blade being fixedly attached to said housing and having a free end portion with said lower contact thereon, said lower flexible blade projecting into said housing a distance sufficient to align said lower contact with said upper contact.

9. The switch of claim 5 wherein said pushbutton has an engagement surface longitudinally aligned with said bumper for applying force to said bumper when said pushbutton is moved to said reset position, and said engagement means being spaced from said engagement surface.

10. A switch having a pair of normally closed movable contacts, a temperature responsive bimetal disc movable from a contacts closed position to a contacts open position responsive to a predetermined elevated temperature, a reciprocating bumper cooperating with said disc an one of said contacts for moving said one contact away from the other said contact when said disc moves to said contacts open position, a manually operable pushbutton movable from a rest position to a reset position for manually returning said disc from said contacts open position to said contacts closed position, said pushbutton having an engagement surface aligned with said bumper for applying force to said bumper for moving same longitudinally toward said disc and thereby return said disc to said contacts open position when said pushbutton is moved to said reset position, and said pushbutton having engagement mean spaced from said engagement surface for moving and holding said other contact away from said one contact when said pushbutton is moved to said rest position to thereby prevent reclosing of said contacts until said pushbutton is returned to said rest position from said reset position.

* * * * *